United States Patent [19]

Van den Sype

[11] 4,404,827

[45] Sep. 20, 1983

[54] METHOD AND APPARATUS FOR DRAWING WIRE

[75] Inventor: Jaak S. Van den Sype, Scarsdale, N.Y.

[73] Assignee: Union Carbide Corporation, Danbury, Conn.

[21] Appl. No.: 282,255

[22] Filed: Jul. 10, 1981

[51] Int. Cl.[3] ..... B21C 9/00

[52] U.S. Cl. ..... 72/41; 72/286

[58] Field of Search ..... 72/41, 45, 42, 286, 72/342, 364, 467

[56] References Cited

U.S. PATENT DOCUMENTS

| | | | |
|---|---|---|---|
| 883,695 | 4/1908 | Canda | 72/286 X |
| 957,464 | 5/1910 | Horton . | |
| 1,427,100 | 8/1922 | Gilbert . | |
| 2,132,581 | 10/1938 | Schuster | 72/286 X |
| 2,165,056 | 7/1939 | Kalischer | 205/21 |
| 2,245,320 | 6/1941 | Bletso | 72/286 X |
| 2,252,365 | 8/1941 | Fisher | 72/286 X |
| 2,336,771 | 12/1943 | Beaman | 72/286 X |
| 2,974,778 | 3/1961 | Ellis et al. | 205/21 |
| 3,080,962 | 3/1963 | Fleischmann et al. | 72/41 |
| 3,577,753 | 5/1971 | Shah et al. | 72/41 |
| 3,740,990 | 6/1973 | Prajsnar et al. | 72/342 |
| 3,973,426 | 8/1976 | Fujita et al. | 72/286 |

FOREIGN PATENT DOCUMENTS

| | | | |
|---|---|---|---|
| 534380 | 9/1931 | Fed. Rep. of Germany | 72/286 |

*Primary Examiner*—Ervin M. Combs
*Attorney, Agent, or Firm*—Saul R. Bresch

[57] ABSTRACT

In a process for drawing wire through the nib of a die comprising lubricating the wire with a dry soap and drawing the lubricated wire through the nib in such a manner that a film of soap is formed on the surface of the nib, the improvement comprising maintaining the working surface of the nib at a temperature lower than that of the melting point of the soap whereby that portion of the film immediately adjacent to the surface of the nib solidifies, and a die therefor.

9 Claims, 5 Drawing Figures

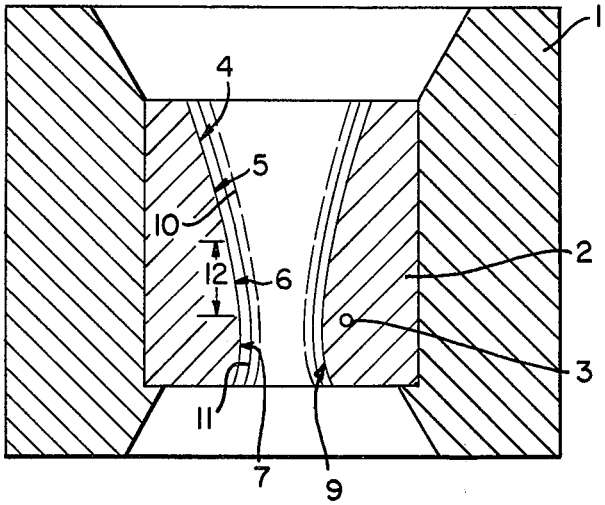
FIG. 1
FIG. 5
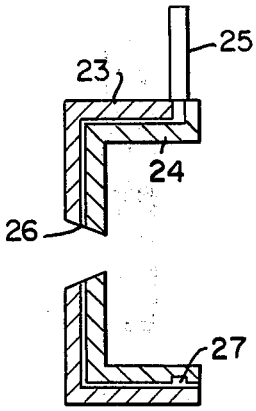
FIG. 2
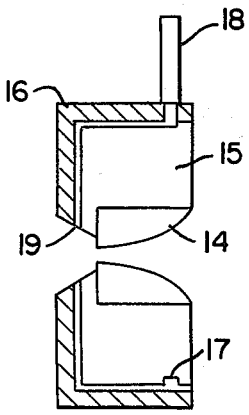
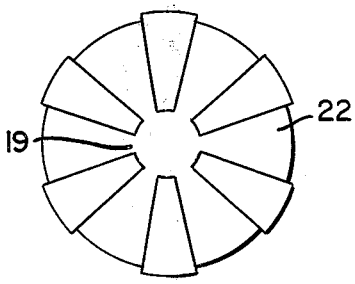
FIG. 4
FIG. 3
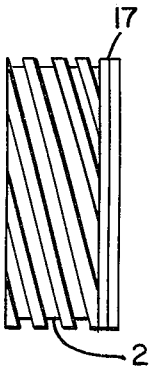

METHOD AND APPARATUS FOR DRAWING WIRE

FIELD OF THE INVENTION

This invention relates to the drawing of wire through a die and the die itself.

DESCRIPTION OF THE PRIOR ART

Wire is conventionally made by drawing wire or rod through a die or a succession of dies, which successively reduce the diameter of the initial material until the desired diameter is achieved. Prior to drawing, the wire is passed through a box filled with a dry soap such as calcium stearate, which may contain a lime or oxalate additive. The soap acts as a lubricant for the wire and the additive is used to increase the viscosity of the soap and thus enhance its function as a lubricant. To further facilitate the passage of the wire through the die, the wire may be coated with copper. Once the wire is in the die, the work of deformation and the friction may raise the temperature of the wire as much as 212° F. to 392° F.

While this adiabatic heating aids the performance of conventional lubricants in that their viscosity is lowered, it causes an exceptional build-up of heat in wire passing through modern high speed, multi-pass drawing machines, so much so that the lubricant breaks down, and there is a large amount of wire-die contact. As one might expect, the frictional forces together with the high surface temperatures reduce die life and cause deterioration of wire properties such as surface quality and wire ductility as measured by number of twists to failure or wrap tests.

In order to counteract this build-up of heat in the wire in high speed drawing, two general approaches have been taken. One is to cool the wire between passes and the other is to cool the die. While the former approach was found to be more effective, neither is capable of extracting enough heat from the wire to substantially reduce the deleterious effects of the generated heat. To this end, then, those concerned with wire drawing are striving to find improved techniques for either extracting more heat from the wire or for improving lubrication efficiency in order to inhibit lubricant break-down. The rewards for achieving this goal are reduction in die wear, which will lower die cost and machine downtime due to die changes; attainment of higher wire drawing speeds; and improvements in surface quality and other properties of the wire.

SUMMARY OF THE INVENTION

An object of this invention is to provide a process which will negate lubricant break-down by improving its efficiency whereby frictional forces are reduced to a minimum and heat build-up can be virtually ignored, and a die in which such a process can be practiced.

Other objects and advantages will become apparent hereinafter.

According to the present invention, an improvement in drawing processes has been discovered which maintains a high degree of lubrication in the face of the persistent generation of heat in high speed, multi-pass wire drawing machines. The process which has been improved upon is one involving the drawing of wire through the nib of a die comprising lubricating the wire with a dry soap and drawing the lubricated wire through the nib in such a manner that a film of soap is formed on the surface of the nib. The improvement comprises maintaining the working surface of the nib at a temperature lower than that of the melting point of the soap whereby that portion of the film immediately adjacent to the surface of the nib solidifies.

Further, an improvement in the die itself has been discovered which provides a means for practicing subject process. The die is one adapted for drawing wire and comprises a casing with a nib disposed centrally therein, said casing being comprised of a material having a high thermal conductivity, (a) said casing including
  (i) inlet and outlet means; and
  (ii) at least one internal passage surrounding the nib and connected to the inlet and outlet means,
the inlet and outlet means and the internal passage being constructed in such a manner that a fluid can pass into the inlet means, through the passage, and out of the outlet means; and (b) said nib including a walled passage through which wire can be drawn, a portion of said walled passage being constructed in such a manner as to provide a working surface for the die.

The improvement comprises providing at least one internal passage having (A) a total surface area for heat transfer of about 0.4 square inches to about 4 square inches; and (B) a cross-sectional area for each passage of about 0.0001 square inch to about to about 0.01 square inch.

BRIEF DESCRIPTION OF THE DRAWING

FIG. 1 is a schematic diagram illustrating the longitudinal cross section of a die. A schematic representation of the lubricant film with the solid portion is also shown. It will be understood that the components are not depicted in proportion to one another from a dimensional point of view, particularly insofar as the film and the solid portion are concerned, the latter not being apparent to the naked eye. That there is a solid portion is deduced from a determination of a temperature lower than the melting point of the lubricant. This determination is effected with the use of thermocouple 3.

FIG. 2 is a schematic representation of a side view of the center section of one embodiment of the die, which is one of the subjects of the invention.

FIG. 3 is a schematic representation of a side view of the outer surface of the inner portion of casing 15 shown in FIG. 2.

FIG. 4 is a schematic representation of a view from the back relief side of the die of the outer surface of the inner portion of casing 15 shown in FIG. 2.

FIG. 5 is a schematic representation of a side view of the outer portion of a casing, which would be used to house an inner portion of a casing and a nib. This is another embodiment of the invention exclusive of the inner casing and nib.

DESCRIPTION OF THE PREFERRED EMBODIMENT

Referring to the drawing:

The die is typical of one which could be used in a high speed wire drawing machine. In FIG. 1, casing 1 surrounds nib 2, in which lies a conical walled passage having entrance and exit apertures. Wire (not shown), having first been coated with lubricant, passes through the entrance of the die. The lubricant coated surface of the wire proceeds until it comes in contact with the working surface of nib 2 where its diameter is gradually reduced by the pressure of the moving wire against the immovable nib.

The various parts of nib 2 and their functions, all of which are conventional, are as follows: bell radius 4 and entrance angle 5 facilitate the entrainment of lubricant toward the working surface. Reduction angle 6 is the apex angle of a conical section which defines the working surface. The angle is typically between about 8 and 16 degrees. Bearing 7 is a cylindrical section following the working surface, its length being typically about fifty percent of the wire diameter. Back relief 9 relieves the friction at bearing 7 and also provides support for the nib.

The working surface of nib 2 is of greatest concern here. It encompasses reduction angle 6 and ends at the beginning of bearing 7. All of the work takes place at the working surface, which is located on the inside surface of the nib in the area delineated by arrows 12, and this is the surface whose temperature must be maintained below that of the melting point of the lubricant. Film 10 is indicated by dashed lines on the surface of nib 2. Solid portion 11 of film 10 is represented by a line between the dashed lines and the interior surface of nib 2. Film 10, of course, interfaces with the wire and the surface of nib 2. Thermocouple 3 is used to determine the temperature at a point slightly removed from working surface 12. FIG. 1 does not show the slits in casing 1 described in the examples, which slits are used for the introduction of liquid nitrogen into the casing. This cooling is responsible for the thickness of film 10 and solid portion 11.

FIGS. 2 to 5 described two embodiments of the invention insofar as it pertains to the die itself. It is preferred that this apparatus is used to carry out the process on a commercial scale. The slits used in the examples as a means for cooling the nib surface are satisfactory for experimentation, but do not have the practical attributes of the preferred embodiments.

FIG. 2 shows a cylindrical die with nib 14 and a casing made of two parts, jacket 16 and interior casing 15. These parts are combined by shrink fitting. Since jacket 16 has a smooth interior surface and interior casing 15 has grooves machined in its outer surface, enclosed passageways are defined when the two parts are shrink fitted together. Jacket 16 is a cup shaped piece with an opening on one side, i.e., the lip side of the cup, sufficiently large to receive interior casing 15. Opposite this opening, in what would ordinarily be considered the bottom of the cup, is a circular aperture through which the wire passes after it leaves the back relief portion of nib 14. Exit 19 is adjacent to this aperture. The liquid cryogen enters inlet pipe 18, which empties into circular manifold 17. It then follows helical grooves on the outer surface of interior casing 15, passes into grooves on the back relief side of the die, and leaves the die as a mixture of liquid and vapor at exit 19, which it will be understood is circumferential. Nib 14 is the same as nib 2 in FIG. 1 except that there is no thermocouple.

FIG. 3 shows the outer surface of interior casing 15 in FIG. 2. The liquid cryogen enters manifold 17 and then proceeds into six parallel helical grooves 21. Grooves 21 are slanted so that each has an entrance from manifold 17 and an exit on the back relief side of the die.

FIG. 4 shows the back relief side of FIG. 3. The six helical grooves empty, respectively, into the six pie-shaped grooves 22, which, in turn, lead to exit 19.

It will be understood that any number of grooves starting with one can be used. The only limitations are the bounds of practicality. For example, it is difficult to effect uniform cooling with one groove and difficult to deliver liquid nitrogen to a high number of small grooves especially in a piece which is as small as a standard die. Six grooves have been found optimum, but four to twelve grooves will be almost as effective. It is considered that the difficulty in providing pieces with more grooves lies in the machining.

Typical dimensions of the grooves in interior casing 15 are as follows: manifold 17 - 1/16 inch deep and 1/16 inch wide; helical groove 21 - 0.005 inch deep and 0.076 inch wide; the depth of pie-shaped groove 22 is 0.005 inch at the outer periphery of casing 15 and gradually deepens so as to keep the cross-sectional area constant. These same dimensions can be used in FIG. 5.

FIG. 5 is a variation of FIGS. 2 to 4. Just as jacket 16 in FIG. 2, it is shaped like a cup with an aperture in the closed end of the cup. In this case, however, the open or lip end of the cup is constructed so that it can accept a standard die casing similar to that in FIG. 1. The cup is made up of an outer jacket 23 and an inner jacket 24. The liquid cryogen enters at inlet pipe 25 and a mixture of liquid and vapor exits at exit 26. The layout of the grooves in inner jacket 24 is essentially the same as the grooves in FIGS. 3 and 4. Thus, for example, manifold 27 is essentially the same as manifold 17 in FIGS. 2 and 3. Since this configuration makes the standard dies interchangeable, the embodiment is more versatile than the one in FIGS. 2 to 4.

A typical die has a nib made of tungsten carbide and a casing, of mild steel. The size of the die nib and casing varies with the size of the wire being drawn, e.g., 0.035 inch wire could be drawn with a nib of 0.325 inch diameter and 0.330 inch height and a casing of 1.5 inch diameter and a height of 0.75 inch. As might be expected, the highest temperature in wire drawing occurs at the working surface of the tungsten carbide nib. From this point, the temperatures drop quite rapidly as one travels away from the working surface toward the outer beraing surface of the nib.

Due to the high mechanical forces generated during wire drawing, it is not feasible to introduce cooling fluids close to the working surface of the die nib. To bring the working surface of the die to the required temperature range, the outside of the nib must be brought into a temperature range of no higher than about minus 148° C.

Nib sizes and casing sizes have been standardized in the industry and are usually serially labeled R1 to R6 depending on the wire sizes being drawn. The most common are R2 and R5 with the following dimensions in (inches):

| | | R2 | R5 |
|---|---|---|---|
| Nib size: | diameter | 0.325 | $\frac{5}{8}$ |
| | length | 0.325 | $\frac{5}{8}$ |
| Casing size: | diameter | 1.5 | 1.5 |
| | length | 0.75 | $\frac{7}{8}$ |
| For drawing wires in the diameter range: | | 0.004 to 0.040 | 0.025 to 0.120 |

During drawing, the heat input by the wire to the die varies between about 200 BTU's per hour and several thousand BTU's per hour depending on, e.g., wire size, area reduction, and speed. For example, in order to extract 700 BTU's per hour (T) from an R5 casing maintained at minus 250° F., the surface heat transfer coefficient (U) is calculated as follows:

1. the area of the outside cylindrical surface of an R5 casing available for cooling (V) is equal to $$1.5\times(22/7)\times(7/8)\times(1/444)=0.0286 \text{ square foot.}$$

2. using liquid nitrogen at minus 320° F. as a refrigerant, the delta T is equal to 320° F. minus 250° F., i.e., 70° F. The surface heat transfer coefficient (U) is, therefore, equal to $$T/(V\times\text{delta T})$$

or 350 BTU's per hour degree F per square foot. The heat transfer coefficient for a liquid nitrogen film boiling with a delta T of 70° F. is about 30 BTU's per hour per degree F per square foot. It is clear that simple immersion or spraying of liquid nitrogen onto an R5 casing will not result in the outside of the die nib having the required cryogenic temperature. Subject process, on the other hand, accomplishes this task. The preferred apparatus can be made in small sizes so that it fits in most standard die boxes. The small size also makes it easier to insulate the cooling apparatus from the rest of the machinery thereby decreasing liquid nitrogen losses and preventing water condensation on the diebox and the soap. The apparatus is also constructed so that liquid nitrogen or cold nitrogen vapor do not contact parts of the diebox where water condensation can interfere with proper performance of the lubricant soap. Finally, the preferred apparatus enables the full utilization of the refrigeration available in the liquid nitrogen.

One die configuration which is effective utilizes cooling passages cut into the die casings. This configuration is used in the examples below. To use the liquid nitrogen efficiently, a selection is made with respect to cooling passage geometry, internal dimensions of the passages, number of passages and series or parallel arrangement of the passages. To realize high heat flux levels, passages having small equivalent diameter are constructed. This produces high Reynolds number flows of liquid cryogen. While it is preferable to maximize total passage length, it is found that several passages in parallel utilize liquid cryogen more effectively than a single passage having the same total length. It is also preferable to avoid designing passageways which would result in a high pressure drop for the liquid cryogen flow.

With regard to subject process, it has been ascertained that a minimum heat transfer film coefficient of at least 200 BTU's per hour per square foot per degree F. is needed in order to obtain the temperature at the working surface of the die, which will form the solid film. This implies gas velocity flows in the passages with gas Reynolds numbers of at least about 10,000. Calculation of a gas Reynolds number with regard to the die illustrated in FIGS. 2 to 4 may be found in example 4 below.

In subject process, a thin film of lubricant is maintained between the outer surface of the wire and the inner surface of the die in order to reduce the friction between these surfaces. Reduced friction with the concommitant reduction in frictional heating aids in reducing the high surface temperatures, which can be generated in drawn wire and which leads to strain aging of, for example, carbon steel wire with resulting embrittlement. Reducing frictional forces also results in a more uniform deformation of the wire and, therefore, better properties, as well as the enhancement of die life.

Although the advantages of hydrodynamic lubricant films are well known in the art of wire drawing, in practice, such films are often difficult to establish and maintain. An article by Nakamura et al. entitled "An Evaluation of Lubrication in Wire Drawing", Wire Journal, June 1980, pages 54 to 58, describes a method for evaluating lubricant performance from observations on the surface of the drawn wire by means of a scanning electron microscope. During drawing, lubricant is carried into the die by the wedge action between the die approach and the wire. When the lubricant film is relatively thin, the surfaces of the wire and die make contact during deformation. This leads to a leveling of the surface of the wire and the formation of smoothed areas. Where lubricant is trapped during the deformation, depression or pits are formed in the drawn wire surfaces. A high percentage of smoothed surface, i.e., with no depressions, indicates poor lubrication and poor die life. The surface condition of the smoothed areas can also vary considerably with drawing conditions, however. In the above mentioned article by Nakamura et al., various drawing techniques are compared with respect to their lubrication efficiency and die life. It is noted that lubricant applicators and forced lubrication, mentioned in the article, can be used to advantage in subject process. In particular, forced lubrication in the form of a pressure die or a Christopherson tube ahead of the drawing die raises the temperature and pressure of the lubricant so that the lubricant flows more easily into the conical working section of the die thereby increasing the entrance film thickness. When the working surface of the die is cooled to a temperature below the melting point of the lubricant, the lubricant viscosity close to the die surface becomes very high and the velocity profile across the film thickness becomes nonlinear. The average lubricant velocity, therefore, slows down and the exit film thickness advantageously increases.

The dry soaps, which can be used in the instant process, are conventional and include various types of metallic stearates. A description of the soaps and their properties can be found in Chapter 10 of Volume 4 of the Steel Wire Handbook. They are generally formed by the reaction of various fatty acids with alkali. Commonly used stearates and their approximate melting points are as follows:

| | |
|---|---|
| calcium stearate | 302° F. |
| barium stearate | 414° F. |
| sodium stearate | 365° F. |

Most commercial lubricant formulations are derived from a mixture of fatty acids and, in addition, contain various amounts of inorganic thickeners such as lime. The principal purpose of these thickeners is to increase the viscosity of the lubricant. The effect of the use of soap mixtures and additives is to make the melting point of the soap somewhat ill defined. An example of this may be found in the Steel Wire Handbook, Volume 4, Chapter 10, page 162, which shows the apparent melting point of sodium soaps as a function of the titer of the fatty acids from which they were derived. The melting points range from 212° F. to 482° F.

Another difficulty relating to the melting points of the metallic soaps used in wire drawing is their pressure dependence. For the purpose of subject process, the melting points should be measured at the pressures obtained during the wire drawing.

An alternative method, which can be used to establish the solidification point of a soap is to determine the viscosity (or its inverse, the fluidity index) as a function of temperature and pressure. The solidification point is determined by the temperature at which the fluidity index becomes zero. Data of this kind is published, e.g., in a paper by Iordanescu et al, "Conditioned Metallic Soaps as Lubricants for the Dry Drawing of Steel", Tr. Mezhdunar. Kongr. Poverkhm., Akt. Veshchestvam, 7th 1976. In this publication, the fluidity index of calcium, sodium, and barium soaps are given as a function of temperature for a pressure of 2200 psi. At higher working pressures, the curves shown shift toward the left. It is seen here that the fluidity index becomes essentially zero at about 212° F. for sodium and calcium stearate and at about 302° F. for barium stearate.

The temperature to which the working surface of the die may be cooled in subject process has no known lower limits except the bounds of practicality, for example, liquid nitrogen temperature. The maximum temperature at the working surface should be no greater than about 212° F. at the warmest location on the surface, i.e., the point on the nib surface where the conical section joins the bearing length section. The temperature at this location can be as high as 662° F. in high speed drawing of carbon steel wire if only conventional water cooling of the die is employed.

Approximately ninety percent of the mechanical energy exerted in drawing wire is converted into heat. The mechanical work expended in the wire while it passes through the die consists of three components: uniform deformation work, shearing work (redundant deformation), and frictional work. The uniform deformation work gives rise to a uniform temperature rise throughout the cross-section of the wire. The shearing work and, in particular, the frictional work induces a temperature rise, which is located mostly in the surface layers of the wire. Upon exiting from the die, the temperature of the wire will, therefore, be lowest in the center of the wire and highest in the surface layers. It is also clear that in ferrous wire drawing, the temperature rises will be much higher for high carbon steel wires since these have a much higher tensile strength than low carbon steel wires. Numerous calculations on the heat generation and temperature rises occurring in wire drawing have been disclosed in the literature. An example of such a calculation is given in a paper by Dr. T. Altan entitled "Heat Generation and Temperatures in Wire and Rod Drawing", Wire Journal, March 1970, pages 54 to 59. From this paper it may be concluded that: (1) the temperature at the surface of the wire while it is exiting the die is substantially higher (by as much as 100° C.) than the temperature at the center of the wire; (2) only about ten percent of the total heat generated during drawing is due to friction and redundant work and, of this ten percent, only about twenty percent (i.e., two percent of the total) is extracted through the die. The remainder of the heat generated (about 98 percent) is carried away with the wire; (3) high surface temperatures of the wire are deleterious to proper drawing due to breakdown of the lubricant and strain-age embrittlement of the surface of the wire, the latter effect being particularly important to high carbon steel wire; (4) as mentioned above, the highest temperature in the die occurs at the conical section of, for example, a tungsten carbide die nib, the temperature at this location running as high as 662° F. in the high speed drawing of carbon steel wire; and (5) although the temperature of the lubricant increases as the wire passes through the conical die channel, for each cross-section the lubricant temperature is approximately constant throughout the lubricant film.

If is noted that if the lubricant film thickness could be substantially increased, the frictional work would be substantially decreased and so would the surface temperature of the wire.

As stated above, the working surface of the nib should be maintained at a temperature lower than that of the melting point of the soap. Since the melting point of the conventional dry lubricant soaps is generally above 212° F., an alternative approach is to keep the working surface at a temperature no higher than about 212° F. The same effect can be achieved by maintaining a casing having high thermal conductivity at a temperature no higher than about minus 148° F. In order to get down to this low temperature, a liquid cryogen having a boiling point of less than about minus 148° F. is used. Examples of useful liquid cryogens are liquid nitrogen, liquid argon, and liquid helium.

The total surface area of the internal passage (s) in the casing can vary between wide limits depending on the size and composition of the wire being drawn and the surface heat transfer coefficient that is achieved between the cryogen and the casing. The formula for the surface area needed for heat transfer is given by:

$$W = \frac{X}{Yx \text{ delta } T} \times 144$$

where: W is the total surface area of the passage(s) in square inches

X is the total heat load imposed by the wire on the die in BUT's/hour

Y is the surface heat transfer coefficient between the liquid cryogen and the casing in BUT's/square foot/hour/° F.

delta T is the temperature difference between the casing and the liquid cryogen, in degrees Fahrenheit.

As described above, the maximum casing temperature is about minus 150° F. Therefore, when using liquid nitrogen as a cooling fluid, the maximum delta T is about 170° F.

The maximum practicable heat transfer coefficient Y is about 1,000 BUT's/square foot/hour/° F. Thus, the minimum heat transfer area for a typical heat load of 500 BTU's/hour is:

$$W = \frac{500}{1000 \times 170} \times 144 = 0.4 \text{ inch}^2$$

The maximum heat transfer area is dictated by the size of the casing that can be used in standard die boxes. For R5 casings (i.e., for wire sizes below about 0.120 inch), the maximum practicable heat transfer area is about 1.5 times the outside cylindrical surface area of the R5 casing or 4.1 inches$^2$. The internal passage(s) in the casing should, therefore, have a total surface area of about 0.4 inch$^2$ to about 4 inches$^2$ and preferably about 1 inch$^2$ to 4 inches$^2$ for wire sizes below 0.120 inch diameter. In any case, the surface area should be sufficient to abstract about 200 BTU's per hour of heat from the casing for wire sizes up to 0.050 inch to about 1000 BTU's per hour for wire sizes up to 0.125 inch. While not as significant, the total length of the internal passages can be about 0.5 inch to about 10 inches and is preferably about 2 inches to about 6 inches for casings up to R5 size. Since each passage surrounds the nib, total length is important in achieving uniform cooling of the working surface.

Another approach to achieve the required cooling is to increase the surface heat transfer coefficient. This can be done by increasing the liquid cryogen velocities through proper design of the cross-sectional area and length of the passage(s) and a high inlet cryogen pressure. Cross-sectional areas of about 0.0001 $inch^2$ to about 0.01 $inch^2$ and preferably about 0.0015 $inch^2$ to about 0.005 $inch^2$ together with the above length will give the high velocities of liquid nitrogen needed to accomplish this objective with inlet cryogen pressures in the range of 20 to 200 psig. These velocities can be translated into gas Reynolds numbers, which are discussed elsewhere in the specification.

For the casings, materials of high thermal conductivity preferably selected are copper and copper alloys, but other materials such as steel and other ferrous alloys can be used. The nibs, requiring the characteristic of hardness, are usually not made of a high conductivity material, but, rather, materials such as tungsten carbide, which is most commonly used. Other nib materials are sapphire, diamond, and alumina.

The following examples, which serve to illustrate the invention, are carried out in accordance with the steps and conditions set forth above in one or more dies as described above and in FIG. 1 of the drawing.

EXAMPLE 1

Carbon steel wire (0.058 inch diameter) is drawn through a die on a single block machine with a twenty percent area reduction to a finish size of 0.052 inch. The drawing die contains a tungsten carbide nib. This nib is a standard R5 nib having a diameter of 0.625 inch and a height of 0.6 inch mounted centrally in a copper casing. The outside dimensions of the copper casing are a diameter of 1.5 inch and a height of 1 inch. A pressure die is used ahead of the drawing die and the lubricant is a medium rich calcium stearate soap having a melting point of 302° F. Narrow slits (0.005 inch by 0.375 inch in cross-section) are provided in the copper casing. The passageways have a total heat transfer area of 2.5 square inches. Liquid nitrogen at 22 pounds per square inch gauge (psig) is introduced into the slits.

A 0.030 inch diameter hole is drilled in the nib of the drawing die and a thermocouple is introduced at a point located about 0.025 inch away from the working surface of the die near the die exit. The die has a 12 degree angle and a 50 percent bearing length. Two samples of wire are drawn.

| | Sample | |
|---|---|---|
| | A | B |
| Wire speed in feet per minute | 405 | 1225 |
| Liquid nitrogen consumption in pounds per hour | 15 | 15 |
| Measured temperature at thermocouple in °F. | minus 229 | minus 130 |
| Estimated temperature at working surface of die in °F. | minus 51 | plus 10 |

It is found that in samples A and B, a lubricant film is formed on the surface of the nib; the portion of the film immediately adjacent and touching the surface of the nib solidifies; the high velocity flow of liquid nitrogen improves the heat transfer characteristics; there is an improvement in lubrication efficiency and die life; the working surface of the die is brought within the desired temperature range with an economical consumption of liquid nitrogen; and the copper casings are essentially isothermal.

EXAMPLE 2

Carbon steel wire is drawn on a commercial multipass drawing machine converting 0.093 inch diameter wire to 0.035 inch wire with passes through six successive dies. Only the last die is cooled with liquid nitrogen. This is the finishing die. It is noted that wire temperatures and speeds increase towards the finishing die so that the finishing die has the shortest life of the six. Also, the finishing die opening determines the product diameter and is, therefore, kept within closer tolerances. The die casing for the finishing die is made of copper and has a design similar to the drawing die used in example 1. The nib is identical to the one used in example 1. A pressure die is used before the finishing die and the lubricant is a sodium stearate soap having a melting point of about 365° F. Take-up (or wire) speed is 1300 feet per minute; are reduction, twenty percent. 10,355 pounds of wire are drawn through the finishing die with the die opening up from an initial 0.034 inch to 0.0353 inch when the test is stopped. The allowed maximum product size if 0.036 inch. Experience indicates that the die opens up from 0.034 inch to 0.036 inch after about 2000 pounds is drawn, without cooling.

It is noted that in this example, the wire is taken up on 65 pound spools and the machine is stopped approximately every 15 minutes for coil changes. During machine stoppages, it is important that the liquid nitrogen supply to the die be stopped. Otherwise the lubricant and wire will freeze in the die and breakage may occur upon restarting the machine. A solenoid valve is, therefore, installed in the nitrogen supply line and activated by the drawing block. It is further noted that, upon restarting, it take some time before the die casing reaches minus 100° C. again. Most of the observed wear can be related to these periods where proper cooling is not present.

When cooling the die from a warm start, the following observations are made:

(i) there is low lubricant carry-through when no cooling is applied ("lubricant carry-through" means the visible amount of lubricant that comes out of the die opening with the wire, but does not adhere to the wire);

(ii) when the casing reaches about minus 58° F. to minus 103° F., a large increase in lubricant carry-through is observed; and (iii) at casing temperatures below minus 100° C., low lubricant carry-through is again observed. The wire surface is considerably smoother than in (i) and the wire diameter is observed to decrease by about 0.0001 inch compared to when on cooling is applied. The observed wire diameter decrease indicates an increase in lubricant film thickness by about 0.00005 inch. This represents, approximately, a doubling of the film thickness.

In this example, the liquid nitrogen consumption is, again, 15 pounds per hour and the estimated temperature at the working surface of the finishing die during that time is about 32° F. from between the second and third minutes to the fifteenth minute (approx.) when the machine is stopped for coil changes.

The findings in this example are the same as in example 1.

EXAMPLE 3

Carbon steel wire is drawn on a commerical multipass drawing machine converting 0.093 inch diameter wire to 0.035 inch wire in six successive drawing dies. All dies are cooled with liquid nitrogen. The die reduction schedule is: 0.075 inch, 0.062 inch, 0.052 inch, 0.044 inch, 0.039 inch, and 0.034 inch. The die casings are made of copper and are of a design similar to those used in example 1. Slit opening for the 0.075 inch and 01.062 inch dies are 0.005 inch and for the other dies, 0.003 inch. Die nibs are standard R2 nibs (0.325 inch in diameter and 0.330 inch in height). Casing temperatures are held at or below minus 148° F. for all six nibs. The wire speed is 1300 feet per minute. 4030 pounds of wire are drawn using liquid nitrogen cooling as in example 2. Except for periods of coil change, it takes 2 to 3 minutes after start-up following a coil change to establish proper temperature conditions. After drawing the 4030 pounds of wire, the finish (or last) die opens up from 0.0341 inch to 0.0343 inch. The liquid nitrogen is then shut off and 200 pounds of wire is drawn without cooling. The finish die diameter is then 0.0347 inch. Similar wear rate differences are observed on the other dies. Observations on lubricant carry-through, lubricant film thickness, and wire roughness (or smoothness) are similar to the observations reported in example 2. In addition, samples of the 0.034 inch wire are taken with and without the liquid nitrogen cooling for examination under the scanning electron microscope. The sample with the liquid nitrogen cooling shows a striking decrease in the amount of smoothed area, the depressions are also depper and much better connected; the smoothed areas also have much more relief. This indicates better lubrication in the areas of decreased smoothness. The wire temperature is measured at the exit of the sixth die with and without liquid nitrogen cooling. No measurable difference is observed. The wire exit temperature is about 252° F.

In this example, the liquid nitrogen consumption is, again, 15 pounds per hour per die and the estimated temperature at the working surface of the finishing die during that time is between 32° F. and 122° F. for the different dies, from between the second and third minutes to the fifteenth minute (approx.) when the machine is stopped for coil changes.

The findings in this example are the same as in examples 1 and 2.

EXAMPLE 4

This example calculates the gas Reynolds number for the die illustrated in FIGS. 2 to 4 using preferred passage dimensions. The dimensions are as follows:

A = length of each of the six helical passages = 3.06 inch

B = width of each helical passage (perpendicular to flow) = 0.076 inch

C = depth of each helical passage = 0.005 inch

D = total heat transfer area of the six helical passages assuming the heat leak from the surroundings cancels the cooling effect of the pie-shaped passages at the back relief side of the die = $6\times2(B+C)$ (A) = 2.97 square inches = 0.02063 square foot.

On drawing wire through the described die as in example 1, the following is found:

E = heat input from drawing = 491 BTU's per hour

F = temperature difference between liquid nitrogen and casing = 41.4° F.

G = liquid nitrogen mass flow = 10.8 pound per hour

H = average heat transfer coefficient- $=E/D\times F=491/0.02063\times41.4)=575$ BUT's per hour per square foot per ° F.

I = equivalent diameter of helical passageway $=4B\times C)/2\ (B+C)=0.00938$ inch J = inlet velocity $=G/(6\times KBC)=3.75$ feet per second K = density of liquid nitrogen = 50.46 pounds per cubic foot L = inlet Reynolds number $=(K\times J\times I)/M=1394$ M = viscosity of liquid nitrogen = 0.0001061 pound per foot per second N = density of gaseous nitrogen = 0.287 pound per cubic foot P = viscosity of gaseous nitrogen $=3.7632\times10^{-6}$ pounds per foot per second Q = gas velocity $=(J\times K)/N=659$ feet per second R = gas Reynolds number $=(N\times Q\times I)/P=39{,}285$ S = measured pressure drop in die casing = 30 psig Note: In order for the casing to operate in the most effective way, it is supplied with high quality liquid nitrogen at, for example, 30 psig. A preferred method of achieving this is the subject of commonly assigned U.S. patent application Ser. No. 282,256 entitled "Process for Delivering Liqid Cryogen" filed in the name of Robert B. Davis on even date herewith and now Pat. No. 4,336,689, and incorporated by reference herein.

The process is one for delivering a liquid cryogen to a use point in an essentially liquid phase at about a constant flow rate in the range of about 4 to about 20 pounds per hour, said use point having a variable internal pressure drop, comprising the following steps: (i) providing said liquid cryogen at a line pressure in the range of about 8 to about 10 times the maximum use point operating pressure; (ii) subcooling the liquid cryogen of step (i) to an equilibrium pressure of no greater than about on atmosphere while maintaining said line pressure; (iii) passing the liquid cryogen of step (ii) through a device having a flow coefficient in the range of about 0.0007 to about 0.003 while cooling said device externally to a temperature, which will maintain the liquid cryogen in essentially the liquid pahse; and (iv) passing the liquid cryogen exiting the device in step (iii) through an insulated tube having an internal diameter in the range of about 0.040 inch to about 0.080 inch to the use point.

I claim:

1. In a die adapted for drawing wire and comprising a casing with a nib disposed centrally therein, said casing being comprised of a material having a high thermal conductivity, (a) said casing including (i) inlet and outlet means; and (ii) at least one internal passage surrounding the nib and connected to the inlet and outlet means, the inlet and outlet means and the internal passage being constructed in such a manner that a fluid can pass into the inlet means, through the internal passage, and out of the outlet means; and (b) said nib including a walled passage through which wire can be drawn, a portion of said walled passage being constructed in such a manner as to provide a working surface for the die, the improvement comprising providing the internal passage with (a) a total surface area for heat transfer of about 0.4 square inch to about 4 square inches; and (b) a cross-sectional area of about 0.0001 square inch to about 0.01 square inch.

2. The die defined in claim 1 wherein the total length of the internal passage is about 0.5 inch to about 10 inches.

3. The die defined in claim 2 wherein there are about 4 to about 12 internal passages in parallel.

4. The die defined in claim 2 wherein each internal passage is connected at one end to a manifold and on the other end to an exit passage.

5. The die defined in claim 1 wherein the total surface area is sufficient to abstract at least about 200 BTU's per hour from the casing.

6. In a process for drawing metal wire through the nib of a die, said die comprised of a casing having at least one internal passage with a nib disposed centrally therein, comprising (i) cooling the casing by passing a cryogenic fluid through the internal passage and (ii) lubricating the wire with a dry soap and drawing the lubricated wire through the nib in such a manner that a film of soap is formed on the surface of the nib, the improvement comprising (a) controlling the temperature of the casing in such a manner that the working surface of the nib is maintained at a temperature lower than that of the melting point of the soap whereby that portion of the film immediately adjacent to the working surface of the nib solidifies; and (b) introducing the cryogenic fluid into the casing at a sufficient pressure to provide a heat transfer film coefficient between the cryogenic fluid and the casing of at least about 200 BTU's per hour per square foot per degree Fahrenheit.

7. The process defined in claim 6 wherein the working surface of the die is maintained at a temperature no higher than 212° F.

8. The process defined in claim 6 wherein the casing is comprised of a material having a high thermal conductivity.

9. The process defined in claim 6 wherein the cryogenic fluid passes through the internal passage at a gas Reynolds number of at least 10,000.

* * * * *